US006872449B2

(12) United States Patent
Weihrauch et al.

(10) Patent No.: US 6,872,449 B2
(45) Date of Patent: Mar. 29, 2005

(54) THERMOPLASTIC MONOFILAMENT FOR BRISTLES

(75) Inventors: Georg Weihrauch, Wald-Michelbach (DE); Hans Ulrich Pusch, Reichelsheim-Laudenau (DE)

(73) Assignee: Pedex & Co. GmbH, Wald-Michelbach (DE)

( * ) Notice: Subject to any disclaimer, the term of this patent is extended or adjusted under 35 U.S.C. 154(b) by 0 days.

(21) Appl. No.: 10/472,037

(22) PCT Filed: Mar. 26, 2002

(86) PCT No.: PCT/EP02/03364

§ 371 (c)(1),
(2), (4) Date: Sep. 17, 2003

(87) PCT Pub. No.: WO02/077334

PCT Pub. Date: Oct. 3, 2002

(65) Prior Publication Data

US 2004/0091704 A1 May 13, 2004

(30) Foreign Application Priority Data

Mar. 28, 2001 (DE) ..... 101 15 556

(51) Int. Cl.[7] ..... D01F 8/00

(52) U.S. Cl. ..... 428/370; 428/373; 428/374; 525/425

(58) Field of Search ..... 428/370, 373, 428/374; 525/425

(56) References Cited

U.S. PATENT DOCUMENTS

| | | | | |
|---|---|---|---|---|
| 2,309,021 A | | 1/1943 | Stonehill | |
| 4,150,674 A | * | 4/1979 | Yung | 442/361 |
| 4,507,361 A | * | 3/1985 | Twilley et al. | 428/373 |

FOREIGN PATENT DOCUMENTS

| | | |
|---|---|---|
| DD | DD 103 933 | 2/1974 |
| DE | 196 40 726 | 4/1998 |
| DE | 198 18 345 | 10/1999 |
| DE | 198 41 974 | 3/2000 |
| DE | 198 48 505 | 4/2000 |
| DE | 199 42 147 | 3/2001 |
| EP | 0 763 611 | 3/1997 |
| GB | 980814 | 4/1961 |
| JP | 03 172132 | 7/1991 |
| WO | WO 97 14830 | 4/1997 |

* cited by examiner

*Primary Examiner*—N. Edwards
(74) *Attorney, Agent, or Firm*—Paul Vincent

(57) ABSTRACT

A thermoplastic monofilament for bristles which are exposed to excessive moisture during use, consists of a polymer mixture of at least one polyamide (PA) and at least one thermoplastic polyester (PE) whose mixing ratio is selected according to the technical, functional properties decisive for the use of the bristle as well as in dependence on the ambient conditions at the location of use decisive for the function of the bristle.

19 Claims, No Drawings

THERMOPLASTIC MONOFILAMENT FOR BRISTLES

This application is the national stage of PCT/EP02/03364 filed on Mar. 26, 2002 and also claims Paris Convention priority of DE 101 5 556.5 filed Mar. 28, 2001.

BACKGROUND OF THE INVENTION

The invention concerns a thermoplastic monofilament for bristles which are exposed to extensive moisture during use.

Bristles of thermoplastic plastic materials are used for the most different types of brushes, paint brushes and the like. They are subjected to greatly differing physical and chemical loads due to their functional use for brushing, painting, polishing, application of media or the like, and owing to the conditions prevailing directly during use or at the location of use. These conditions include in particular the use of auxiliary agents such as detergents, cleaning agents, cosmetics, water or the like. Should the location of use have high ambient humidity, the drying of moist auxiliary agents is thereby precluded.

For this reason, bristles must have properties which meet these highly differing requirements. These different requirements are illustrated and exemplified by a toothbrush, wherein the bristles have an extremely small diameter of between approximately 0.05 and 0.4 mm and are disposed at a small separation from each other and also densely packed into bundles. Toothbrush bristles must have good bending properties to be able to bend within the purely elastic range and to return to the initial position without deformation (bend recovery). Due to the plurality of different movements and differing user-dependent individual application of pressure for brushing her/his teeth, the bristles must have a good fatigue strength under reversing bending stresses as well as long term stability for an appropriate period of use. The plastic material must be structured such that the bristle can be processed in mechanical or thermal production procedures, in particular for mounting the bristles to the bristle carrier. Finally, the bristles must be rounded at the useful end to produce protective and at the same time sufficient brushing action on the tooth surfaces and in the interdental spaces without damaging the enamel due to excessive hardness, edges or the like and without injuring the gums.

Due to the required dense bristle stock of a toothbrush, the auxiliary agents used, e.g. tooth paste, water etc., as well as the excessive moisture in the air at the location of use, e.g. bathroom, the bristles are constantly subjected to moisture. Drying proceeds slowly due to the dense bristle stock and the ambient conditions.

As has been previously noticed with earlier natural bristles, the excessive moisture weakens the bristles. Such failure was referred to as "wet breakdown" (U.S. Pat. No. 2,309,021). With natural bristles, this failure is mainly due to the loss of natural fat during washing and cleaning processes, the fat serving a hydrophobic role for the living animal. This process in a toothbrush is further enhanced by hydrolytic interaction between tooth cleaning agents and the bristle and by abrasive particles in the tooth cleaning agents. Attempts had been made to overcome this "wet breakdown" through surface chemical treatment of the natural bristle.

For the above reasons, the natural fibers of toothbrushes could only be replaced by synthetic plastic materials when high-quality thermoplastic materials became available. Today, bristles for toothbrushes exclusively use high quality polyamides, in particular PA 6.10 or 6.12. Polyamides of such quality are correspondingly expensive, in particular since these high-quality polyamides are too expensive for other applications.

Although high-quality polyamides have excellent strength properties, they absorb significant amounts of moisture thereby compromising their favorable strength characteristics. This reduction in strength leads to failure of the bristle, the earlier the smaller its diameter, since the moisture rapidly penetrates into the bristle core. Today, toothbrushes are often characterized on the basis of bristle hardness, e.g. soft, medium or hard, which is mainly determined by the bristle diameter. This characterization and grading looses its validity after a period of use due to the influence of moisture. The absorption and retention of moisture in the bristle gaps also leads to considerable hygienic problems since the moisture promotes bacterial growth which would require even longer drying times that cannot be achieved in practice (U.S. News & World Report 12.10.87, page 88).

Many other types of thermoplastic monofilaments have been repeatedly tried and tested for different kinds of bristles. In particular, bristles of thermoplastic polyesters have a comparable bending behavior and fatigue strength under reversing bending stresses but have not yet been successful for toothbrushes. This is attributable to their increased hardness and resulting danger of injury to gums and enamel. Moreover, they tend to split and form ridges during mechanical processing, in particular during rounding of the useful ends. In addition, they have an increased tendency of binding dirt, i.e. are difficult to clean by rinsing of the toothbrush.

Co-extruded filaments are known from textile technology (EP 0 763 611 A1) which consist of a polyester core and a polyamide jacket. The requirements on such applications are, however, different from those for bristles. Co-extruded monofilaments for toothbrushes are also known (WO97/14830) which consist i.a. of a polyamide jacket and a polyester core. Only high-quality polyamides are used for the jacket. In a further variant with a jacket of polyamides of lower quality, the core consists of a copolyether ester which is an elastomer and therefore does not meet the requirements for toothbrush bristles. The same is true for another known composite structure (GB 980 814), having a core and jacket made from differently treated polyvinyl chlorides.

It is the underlying purpose of the invention to propose a monofilament for bristles whose properties can be optimally adapted to the desired functional, technical requirements and ambient conditions during use and at reduced material cost.

SUMMARY OF THE INVENTION

The object of the invention is achieved with a thermoplastic monofilament which forms the starting material for bristles in that the monofilament comprises a polymer mixture of at least one polyamide (PA) and at least one thermoplastic polyester (PE).

The precise mixing ratio (PA/PE) is selected in dependence on the relevant technical, functional properties for use of the bristle and on the ambient conditions relevant for the function of the bristle at the location of use.

Polymer mixtures (polymer blend) almost invariably form multi-phase systems such as those also known from metal alloys. Their behavior when mixed is different from that of many low-molecular materials which e.g. dissolve and form a single-phase system. The reason therefor is the molecular interaction due to Van der Waals, dipole and hydrogen interactive forces which are more effective for similar macromolecules than between different polymers in the mixing phase. Moreover, the degree of looping of the macromolecules and the entropy increase during mixing is important, which, due to the steric effects, is smaller for macromoles than for low-molecular substances.

For blends of thermoplastic polyester and polyamides, the polar groups of both polymers have a positive effect on the mixing properties. The different segment lengths are the basis of the tendency to multi-phases which is desired if the technical physical and chemical properties of the components involved in the mixture are maintained with sufficiently high binding forces, which is the case with a PA/PE blend. This is due to the fact that, in contrast to homogeneous blends, the morphology of the mixing phase PA/PE largely displays the natural crystallinity of the individual components such that the positive properties of the polymers forming the blend are maintained. PA/PE blend filaments have a reduced rigidity compared to pure polyester, however, a better damping behavior which corresponds more to that of nylon. The mixing phase has a dispersion-like character which explains the improved impact strength compared to the pure mixing components.

The polymer portions of the blend for extrusion of the thermoplastic monofilament can be optimally adjusted to the requirements for the bristle. The bending behavior and the bend recovery can be adjusted corresponding to the bristle diameter and length and to the precise type of use of the bristle (toothbrushes, massage brushes, hand brushes, cosmetic brushes, paint brushes etc.). It can also be adjusted to the physical and chemical conditions prevailing at the location of use due to the media used (tooth cleaning agents, cleaning agents, water etc.) and the prevailing ambient conditions (dry or moist atmosphere, retention of moisture in the bristle stock etc.).

DESCRIPTION OF THE PREFERRED EMBODIMENT

The mixing ratio (PA/PE) can be varied within large limits without considerably impairing the stability of the mixing phase. The mixing ratio PA/PE can e.g. vary between 10/90 mass % and 90/10 mass % and is preferably between 20/80 mass % and 80/20 mass %.

If the bending strength and its durability during use even under extremely moist conditions is the most important requirement, the PE portion is increased by reducing the PA portion. An appropriate PA fraction improves the bend recovery in the dry state. Vice versa, the bend recovery in extremely moist ambient conditions is impaired by a high PA portion due to the increased water absorption of PA. If the sliding quality of the bristle and the cleaning effectivity (abrasion behavior) are most important, the PA portion is increased by reducing the PE portion which simultaneously leads to protective treatment of the surface to be cleaned and its surroundings (e.g. the enamel, the gums). An optimum mixing relationship PA/PE which best meets the requirements for toothbrushes, is a PA portion of between 10 and 30 mass % and a PE portion of between 70 and 90 mass %.

Moreover, the mixing ratio can be adjusted to the bristle geometry taking into consideration the ambient conditions at the location of use. The PE portion of the mixing ratio will be higher, the smaller the cross-section of the bristle to prevent penetration of moisture into the thin cross-section and associated impairment of the bending behavior and bend recovery.

It is advantageous to increase the PE portion, reducing the PA portion, irrespective of the geometrical shape of the bristle, the stronger and/or more persistent the influence of moisture at the location of use of the bristle. This recommendation is not however absolutely necessary since absorption of moisture by the brush is desired in some applications to improve the binding of the liquid application media to the bristle.

The thermoplastic polyester is preferably a polyalkylene terephthalate (PAT), wherein in particular polyethylene terephthalate (PET) or polybutylene terephthalate (PBT) or a mixture thereof can be used.

These thermoplastic polyesters are particularly suited for bristles not only because of their technical properties but also since they are much less expensive than the polyamides, e.g. PA 6.12, which have been used for toothbrush bristles up to now.

A high proportion of PAT also permits at least partial replacement of high-quality PA with lower-quality and less expensive PA, e.g. PA 6.

The polyamide component of the mixture can be selected e.g. from the group of higher-quality polyamides, such as PA 6.10, PA 6.12, PA 11, PA 12 and the group of lower-quality polyamides, such as PA 6, PA 6.6 thereby taking into consideration that the mixing phase must have sufficient stability.

The invention also concerns a thermoplastic monofilament in the form of an at least two-layer co-extruded material for bristles which are subjected to extensive moisture during use. In such co-extruded material, at least one layer consists of a polymer mixture of the above-described composition.

The two layers of the co-extruded material can be concentric, i.e. a core and a jacket. Alternatively, the co-extruded material can comprise several monofilaments which are embedded in a second layer which defines the outer cross-section of the monofilament. Moreover, the co-extruded material can consist of a core which defines only a portion of the periphery while the second layer forms segments completing the periphery, i.e. can have a substantially rectangular cross-section which is mainly formed by one layer, whereas the other layer only forms the corners.

Irrespective of the precise geometry of the co-extruded material whose one layer is formed by the polymer mixture of the inventive type, the second layer can consist of a single polyamide or a mixture of polyamides and vice versa. The second layer can also be formed of a thermoplastic polyester of a mixture of such polyesters.

If the co-extruded material consists of a core and a jacket, the core preferably consists of a PAT or a mixture of polyalkylene esters, while the jacket is formed of a polyamide or a polyamide mixture.

In the case of a toothbrush bristle, the core substantially determines the bending behavior and the bend recovery whereas the jacket substantially provides the brushing effect for distribution of the application or cleaning media. Although the jacket of such a bristle absorbs an increased amount of water, this has, however, no or only little effect on the moisture properties since these are mainly determined by the core which has considerably reduced absorption of moisture.

The core can also be made from one thermoplastic polyester or from a polyester mixture since it is not directly involved in the brushing action, with the jacket then having the inventive polymer mixture. The inventive polymer mixture can be present in the core and also in the jacket, wherein the PE or PAT portion in the core and the PA portion in the jacket can be increased.

The excellent rigidity properties of the inventive polymer mixture permit structures having a core consisting of this mixture covered by a jacket made from any polymer, in particular PA or a PA mixture. This permits different coloring of the jacket, which is limited with PE and PE mixtures, whereas e.g. polyamides are particularly easy to color. This material combination also allows the jacket to be extremely thin. Depending on the application, the bristle diameter can vary between 5.0 mm for rough brushes, e.g. street brushes, and 0.1 mm for toothbrushes, cosmetic brushes etc. For bristles having a diameter of between 0.5 and 5.0 mm, the jacket can have a thickness between 0.01 and 0.5 mm. For toothbrush bristles having a diameter range of 0.1 to 0.3 mm, the thickness of the jacket can be between 10 and 50$\mu$. This permits creation of a wear display, wherein, with increasing length of use, the colored jacket is removed and the non-colored or differently colored core is exposed to show the user the degree of wear.

The properties of the inventive polymer mixture which determine the stability also permit three-layered co-extruded material structures with e.g. a core containing PAT or a PAT mixture, an intermediate layer of an inventive polymer mixture, and an outer layer of an elastomer or an elastomer blend. In this context, a copolyether ester is particularly recommended due to its affinity to the polyester portion of the central layer. In this case as well, the outer useful layer provides optimum conditions for meeting the requirements for brushing, cleaning, for massage or for the application of media.

Finally, the core can be formed as a hollow core to absorb media and release them at the free end of the bristle.

Should the jacket consist of the inventive polymer mixture or of PA or a PA mixture, a bristle which consists of core and jacket can be mechanically treated at the bristle ends with improved quality and, in particular, perfectly rounded without the formation of edges.

We claim:

1. A thermoplastic monofilament in the form of an at least two layer, co-extruded material for bristles which are subject to a high degree of moisture during use, the monofilament comprising:

a core; and a jacket, wherein at least said jacket is made from a polymer mixture containing at least one polyamide (PA) and t least one thermoplastic polyester (PE), wherein a mixing ratio PA/PE of said polymer mixture has a 10 to 30 mass % portion of PA and a 70 to 90 mass % portion of PE, wherein said core is a polyamide or a mixture of a high-quality polyamide and a low-quality polyamide.

2. The monofilament of claim 1, wherein polyamide components are selected from the group consisting of PA 6, PA 6.6, PA 6.10, PA 6.12, PA 11 and PA 12.

3. The monofilament of claim 1, wherein said core consists of pure PAT or a mixture of polyalkylene esters.

4. The monofilament of claim 1, wherein said core is made from said polymer mixture in which saId mixing ratio PA/PE has 10 to 30 mass % portion of PA and a 70 to 90 mass % portion of PE.

5. The monofilament of claim 1, wherein at least one layer of the two-layered co-extruded material is colored to provide an optical difference with respect to the other layer.

6. The monofilament of claim 1, wherein said core has a diameter of between 0.1 and 5.0 mm and said jacket has a thickness of between 0.001 and 0.5 mm.

7. The monofilament of claim 6, wherein said core has a diameter of between 0.1 and 0.3 mm and said jacket has a thickness of between 0.001 and 0.005 mm.

8. The monofilament of claim 7, wherein the bristles are toothbrush or cosmetic brush bristles.

9. The monofilament of claim 1, wherein the monofilament is a three-layered co-extruded material having said core and said jacket and further comprising an outer layer of an elastomer.

10. The monofilament of claim 1, wherein said core has a hollow center.

11. A thermoplastic monofilament in the form of an at least two layer, co-extruded material for bristles which are subject to a high degree of moisture during use, the monofilament comprising:

a core; and a jacket, wherein at least said jacket is made from a polymer mixture containing at least one polyamide (PA) and least one thermoplastic polyester (PE), wherein a mixing ratio PA/PE of said polymer mixture has a 10 to 30 mass % portion of PA and a 70 to 90 mass % portion of PE, wherein said core consists of a thermoplastic polyester or a mixture of thermoplastic polyesters including polyesters selected from the group consisting of polyalkylene therephthalate (PAT), polyethylene terephthalate (PET), and polybutylene terephthalate (PBT).

12. The monofilament of claim 11, wherein said core consists of pure PAT or a mixture of polyalkylene esters.

13. The monofilament of claim 11, wherein said core is made from said polymer mixture in which said mixing ratio PA/PE has 10 to 30 mass % portion of PA and a 70 to 90 mass % portion of PE.

14. The monofliament of claim 11, wherein at least one layer of the two-layered co-extruded material is colored to provide an optical difference with respect to the other layer.

15. The monofliament or claim 11, wherein said core has a diameter of between 0.1 and 5.0 mm and said jacket has a thickness of between 0.001 and 0.5 mm.

16. The monofilament of claim 15, wherein said core has a diameter of between 0.1 and 0.3 mm and said jacket has a thickness of between 0.001 and 0.005 mm.

17. The monofilament of claim 16, wherein the bristles are toothbrush or cosmetic brush bristles.

18. The monofilament of claim 11, wherein the monofilament is a three-layered co-extruded material having said core and said jacket and further comprising an outer layer of an elastomer.

19. The monofilament of claim 11, wherein said core has hollow center.

* * * * *